United States Patent [19]

Smith

[11] Patent Number: 4,469,223

[45] Date of Patent: Sep. 4, 1984

[54] PAINT BRUSHES

[75] Inventor: Morley L. Smith, Beaconsfield, Canada

[73] Assignee: T. S. Simms & Co. Limited, Saint John, Canada

[21] Appl. No.: 450,116

[22] Filed: Dec. 15, 1982

Related U.S. Application Data

[63] Continuation-in-part of Ser. No. 377,470, May 12, 1982.

[51] Int. Cl.[3] ..... B65D 81/22; B65D 85/00

[52] U.S. Cl. ..... 206/209; 206/361; 206/362; 206/374; 206/375; 15/143 R; 15/176; 15/202

[58] Field of Search ..... 15/194, 193, 185, 202, 15/176, 145, 143 R; 206/209, 361, 362, 375, 374, 362.2, 209.1

[56] References Cited

U.S. PATENT DOCUMENTS

| | | | |
|---|---|---|---|
| 1,934,316 | 11/1933 | Loomis | 206/361 |
| 1,963,548 | 6/1934 | Ehrhardt | 206/209 |
| 2,326,879 | 8/1943 | Neahausen | 15/176 |
| 2,514,496 | 7/1950 | Jones et al. | 15/202 |
| 2,712,145 | 7/1955 | Karnes | 15/202 |
| 3,600,740 | 8/1971 | Ogier | 206/374 |
| 3,757,376 | 9/1973 | Coombes | 15/176 |
| 3,874,021 | 4/1975 | Jacobs | 15/143 R |

FOREIGN PATENT DOCUMENTS

| | | | |
|---|---|---|---|
| 18476 | of 1912 | United Kingdom | 15/185 |
| 1382810 | 11/1973 | United Kingdom | 15/176 |

*Primary Examiner*—William T. Dixson, Jr.
*Attorney, Agent, or Firm*—Fetherstonhaugh & Co.

[57] ABSTRACT

A ferruleless paint brush comprises, a bristle knot having one end embedded in a rigid molded plastic head and a detachable handle. The handle is molded to a form which adapts it for engagement with the head which is likewise adapted such that the head and handle are releasably engagable. The head may be pivotally mounted on the handle. In addition the head may be in the form of a plurality of modules one or more of which may be employed to provide heads of different widths. A storage device for paint brushes is also provide. The storage device comprises; a receptacle having a chamber proportioned to receive at least a major portion of a paint brush head in a close-fitting relationship and a closure cap adapted to sealingly engage the receptacle to seal said chamber. A valve opens into the chamber through which conditioning fluid may be introduced into said chamber when said cap is sealed to said receptacle.

10 Claims, 14 Drawing Figures

PAINT BRUSHES

RELATED APPLICATIONS

This application is a continuation-in-part of application Ser. No. 377,470 filed May 12, 1982.

FIELD OF INVENTION

This invention relates to paint brushes. In particular, this invention relates to ferruleless paint brushes and their method of manufacture.

PRIOR ART

In the conventional bristle paint brush the bristles are secured to the handle by means of a metal ferrule. The metal ferrule is permanently attached to the handle and serves to permanently attach the bristles with respect to the handle. In the manufacture of bristle paint brushes a metal ferrule is manufactured and a bristle knot is assembled and located with the proximal end of the knot disposed within the metal ferrule to effectively close one end of the ferrule. A body of plastic resin material is then poured into the opening formed at the other end of the ferrule and the proximal ends of the bristles of the knot are held fast within the ferrule by the body of plastic material after it has set. The end of the handle is then inserted into the open end of the ferrule and the ferrule is secured to the handle by nailing it to the handle or by crimping it into engagement with the handle.

The metal ferrule has long been used as a mold within which the plastic material is allowed to set to secure the bristles and for the purposes of a connector for permanently connecting the bristles to the handle of the brush.

Paint brushes in which the paint applying element is in the form of a body of foam plastic material or the like have previously been manufactured such that the foam element can be removed and replaced. To date no such facility has been available in paint brushes in which the paint applicating element is a bristle knot.

I have found that I can manufacture a ferruleless paint brush.

In one preferred form my ferruleless paint brush has a bristle knot which has a rigid molded plastic head formed at one end thereof in which the bristles are embedded and held fast.

Preferably the head of my paint brush is detachable from a paint brush handle.

To facilitate the attachment and release of the head and the handle of my paint brush, I form the head and handle so as to be quickly attached and released from one another.

To provide a convenient mounting for the head and the handle I form the handle so that it has a bifurcated distal end, and I form the head so that mounting channels are formed at opposite side faces of the molded plastic head to receive the bifurcated end of the handle in the close fitting interlocking relationship.

In the manufacture of the paint brush head I form a rigid molded plastic head at the proximal end of a bristle knot in a mold and I remove the thus formed plastic head with the bristles embedded therein, from the mold after the plastic material has set.

SUMMARY OF THE INVENTION

According to one aspect of the present invention, a paint brush comprises a paint brush comprising; a bristle knot having a distal end and a proximal end, a rigid molded plastic head formed at the proximal end of the bristle knot, the bristles of said knot having their proximal ends embedded in and held fast by said molded plastic head.

According to a further aspect of the present invention, a method of forming a paint brush head comprising steps of: forming a bristle knot having a distal end and a proximal end, the bristles of said knot being arranged to extend longitudinally between the distal and proximal ends, molding a body of plastic material onto the proximal end of the knot to form a rigid plastic head in which the proximal ends of the bristles are embedded and held fast.

According to yet another aspect of the present invention there is provided a method of forming a paint brush as described in the preceding paragraph wherein, prior to molding, the distal end of the knot is located in a mold and subsequent to molding the mold is removed to expose the head.

According to a still further aspect of the present invention there is provided a storage device for paint brushes which comprises a receptacle having a chamber form therein, said chamber being proportioned to receive at least a major portion of paint brush head in a close fitting relationship, and a closure cap adapted to sealingly engage the receptacle to seal said chamber.

According to a still further aspect of the present invention there is provided a paint brush storage assembly which comprises a storage container having a storage enclosure, a plurality of receptacles each having a chamber form therein, each chamber being proportioned to receive at least a major portion of a paint brush head in a close fitting relationship, said storage container being formed with a plurality of compartments each adapted to receive and support one of said receptacles in an upright side by side relationship and a closure cap adapted to engage said storage container to close said compartment.

According to yet another aspect of the present invention there is provided an airtight bristle enclosure for paint brushes of the type having a bristle knot projecting from one end of a head of a handle comprising a receptacle having a chamber form therein, said chamber being proportioned to house said bristle knot, said chamber having an open end proportioned to admit said bristle knot, said open end being adapted to sealingly engage said one end of said head thereby to provide an airtight enclosure of said chamber when said bristle knot is located therein, whereby a paint solvent fluid may be stored in said chamber in contact with said bristle knot.

According to a further aspect of the present invention, a paint brush storage assembly comprises a paint brush head having a bristle knot projecting from one end thereof, a receptacle having a bristle storage chamber formed therein, of said chamber being proportioned to house said bristle knot, said chamber having an open end proportioned to admit said bristle knot to said chamber, said open end being adapted to sealingly engage said one end of said head thereby to provide an airtight enclosure of said chamber when said bristle knot is located therein, whereby a paint solvent fluid may be stored in said chamber in contact with said bristles.

The invention would be more clearly understood after reference to the following detailed specification read in conjunction with the drawings wherein.

Figure 1:
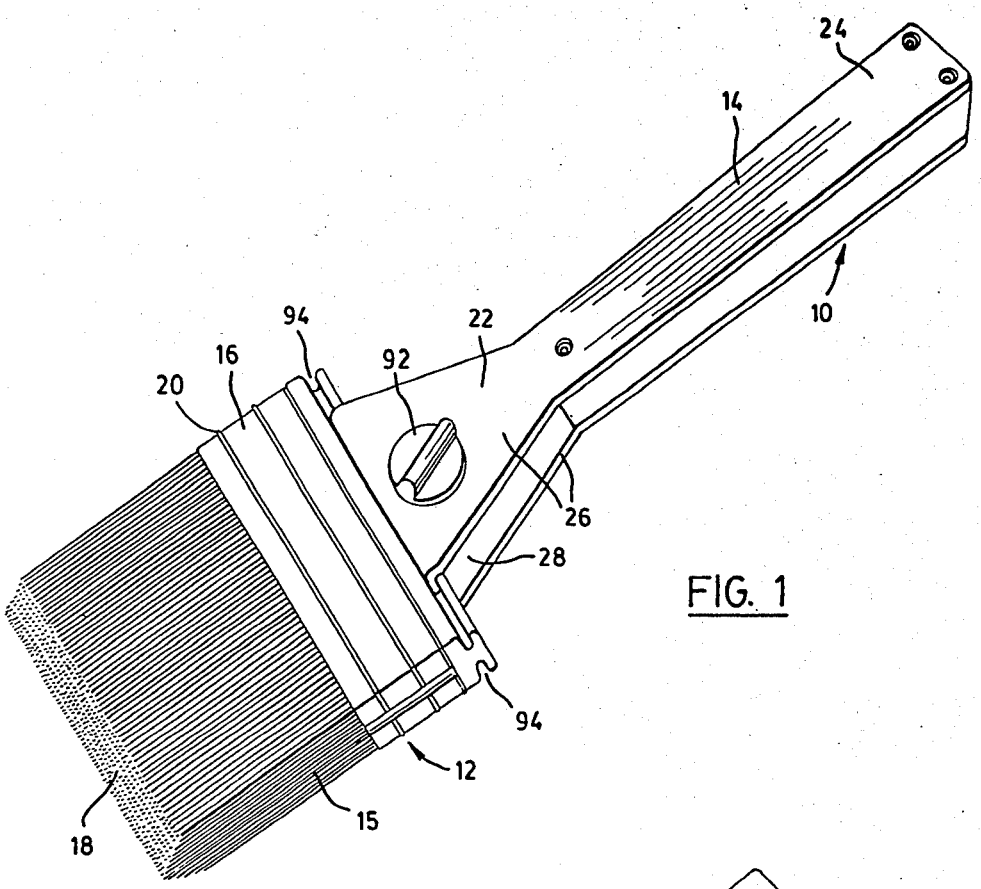
FIG. 1 is a pictorial view of a paint brush constructed in accordance with an embodiment of the present invention.

With reference to FIG. 1 of the drawings, the reference numeral 10 refers generally to a paint brush constructed in accordance with an embodiment of the present invention. Brush 10 comprises a bristle element 12 and a handle member 14. The bristle element 12 comprises a bristle knot 15 and a rigid molded plastic head 16. The bristle knot 15 has a distal end 18 and a proximal end 20 which is embedded in the body of the rigid molded plastic head 16. The proximal ends of the bristles of the knot 14 are embedded in the plastic head 16 and held fast thereby. The handle 14 has a distal end 22 and a proximal end 24. The distal end 22 is bifurcated to provide a pair of arms 26 between which a head mounting passage 28 is formed. The head mounting passage opens forwardly from and laterally of the distal end whereby heads 16 of various widths may be located within the mounting passage 28. A quick release clamping screw extends between the arms 26 and has a end portion 92 which is manually engageable so as to be rotatable to cause the jaws to move toward and away from one another. The proximal end of the head 16 has a pair of mounting channels 94 extending longitudinally thereof. The distal ends of the arms 26 are formed with an inwardly projecting lip which is adapted to extend into engagement with the channels to releasably secure the head 16 with respect to the handle when the arms are in the clamping position.

The resin from which the rigid molded plastic head 16 is made is preferably a high speed curing resin such as a solvent free, two component, polyurethane adhesive, such as that sold by Henkel Corporation and identified by the trade mark MACROPLAST in which the resin is identified as MACROPLAST resin UK 8201 and the hardner is identified as UK5400. The handle is a molded plastic member and may be formed by any conventional plastic molding method.

To mount the bristle assembly 12 on the handle 14 it is merely necessary to release the clamping pressure applied by the arms 26 and to slide the ends of the arms 26 into the slots 94 of the head and then apply a clamping force by tightening the clamping screw 92 until the head is held fast.

Figure 2:
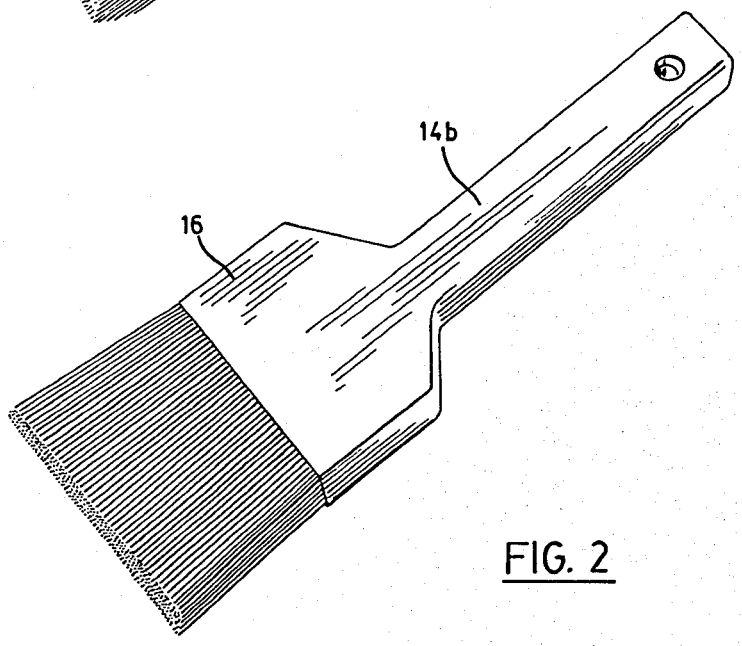
FIG. 2 is a pictorial view of a paint brush constructed in accordance with a further embodiment of the present invention.

FIG. 2 of the drawings illustrates a further embodiment of the present invention in which handle **14*b* is formed as an integral part of the head 16**. That is to say when the head is formed to embed the bristles the mold is shaped to provide a handle as an integral part of the head.

Figure 3:
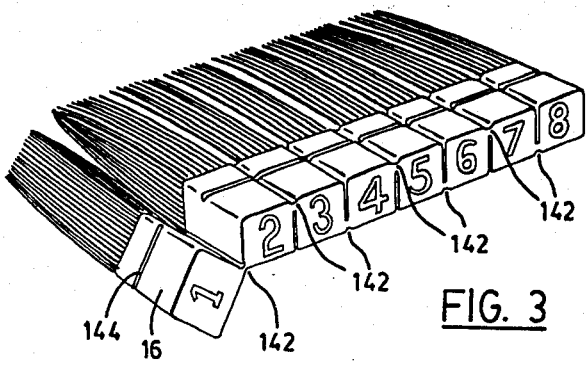
FIG. 3 is a pictorial view of a modular head for a paint brush constructed in accordance with an embodiment of the present invention.
Figure 4:
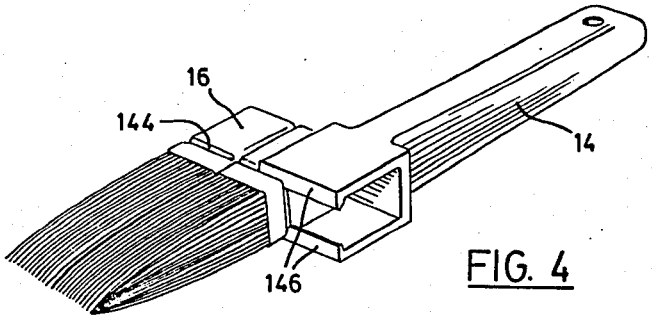
FIG. 4 is an end view of a paint brush consisting of a plurality of segments of the head of FIG. 3 and a handle.
Figure 5:
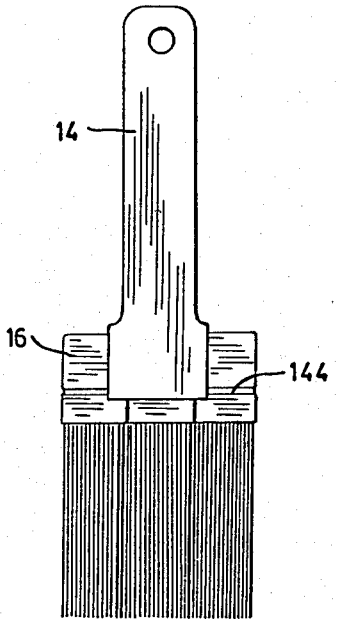
FIG. 5 is a pictorial view of a paint brush illustrating the manner in which the modules of the head of the paint brush are mounted in the handle.

FIGS. 3, 4 and 5 illustrate an embodiment of the invention wherein the head 16 is of a modular construction. As shown in FIG. 3 the head consists of eight segments identified as segments 1, 2, 3, 4, 5, 6, 7, and 8. Planes of weakness 140 are formed in the head between adjacent segments. The planes of weakness are formed by forming the head so that the segments are only interconnected along narrow shoulders 142 which are alternately disposed adjacent opposite sides of the head across the width thereof. The divisions between the segments may be formed by machining the head after it is molded or they may be formed by providing appropriate core elements in the mold in which the head is formed. The head is formed with a pair of oppositely disposed mounting channels one for four extending longitudinally of opposite side faces. The mounting channels being adapted to receive the jaws 146 of the handle 14 whereby the head is releasably secured to the handle. It will be apparent that the segments of the head may have a width corresponding to the unit widths normally employed to distinguish brushes of different widths. That is to say each segment may have a width of ½ inch so that a brush having a width varying from ½ inch upward in ½ inch increments may be provided.

Figure 8:
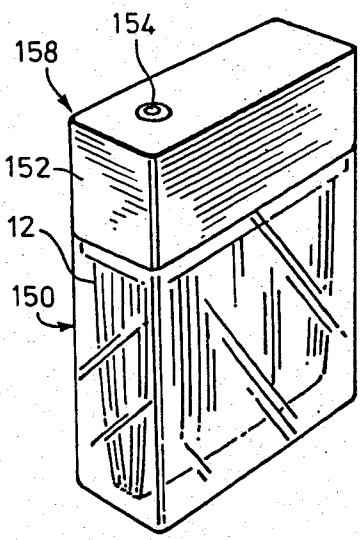
FIG. 8 is a pictorial view of the receptacle of FIG. 7 in a closed configuration enclosing a paint brush head.
Figure 7:
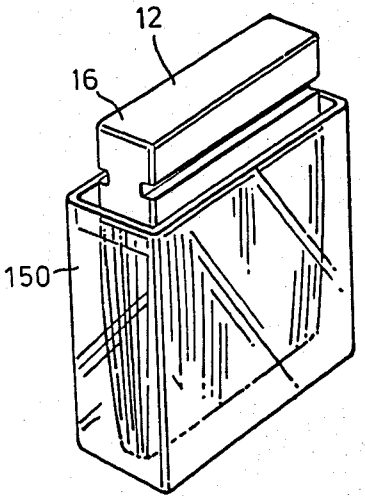
FIG. 7 is a pictorial view of the receptacle of FIG. 6 illustrating a paint brush head mounted in the receptacle.
Figure 6:
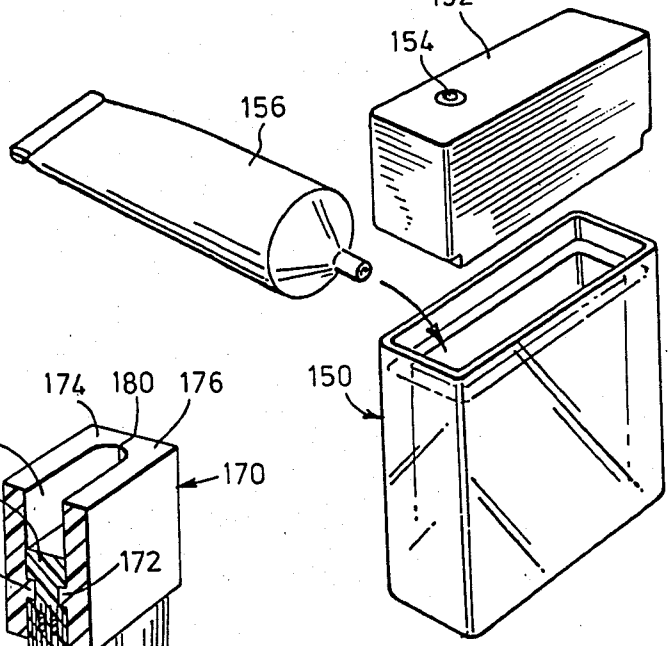
FIG. 6 is an exploded pictorial view of a receptacle for storing paint brush heads together with a source of cleaning agent.

FIGS. 6, 8, and 8 illustrate a further aspect of the present invention. A container 150 having a cap 152 is provided for receiving and storing a head 16 of a paint brush of the type previously described. The container 150 is preferably made from a translucent plastic material which is not sensitive to paint thinners and cleaners. The cap 150 is formed with a self-sealing valve member 154 of the type which will permit a fluid injection needle to penetrate it to permit the introduction of fluid while being resealable to prevent the escape of fluid. The container 150 is proportioned to receive the head 16 in a close fitting air-tight sealing relationship while providing sufficient space surrounding the bristles to accommodate a supply of paint thinner sufficient to permit the bristles to be fully submerged in contact with the cleaning fluid. Thinning fluid from a container 156 is initially introduced into the empty receptacle 150. The paint brush head assembly 12 is positioned in the receptacle with the bristles extending into the body of the fluid within the receptacle 150. The cap 152 is then positioned to close the end of the receptacle 150 and thereby enclose the head assembly 12. Additional cleaning fluid is then introduced through the valve 154 so that air is evacuated from the chamber surrounding the paint brush head assembly 12 and is replaced by thinning and cleaning fluid. It will be apparent that this structure will serve to retain a paint brush head assembly 12 in a good working condition over an extended period of time because the bristles are maintained in a body of thinner. Furthermore, it will be apparent that this mechanism permits an efficient use of thinner material without permitting the fumes normally associated with paint thinners to escape to the surrounding atmosphere. The assembly 158 which comprises the receptacle 150, the cap 152, and a paint brush head assembly 12 is a compact assembly which can easily be stored. By forming the receptacle 150 so that it is translucent it is possible to determine the colour of the paint in association with which the brush has previously been used so that one can very easily make the correct selection when wishing to apply a similar paint.

Figure 9:
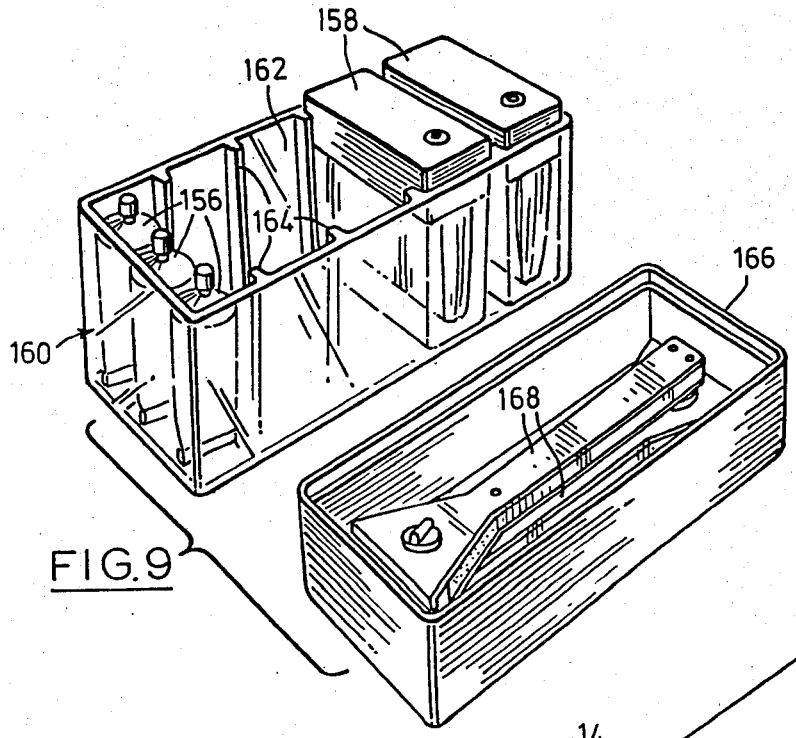
FIG. 9 is a pictorial view illustrating a storage device for storing a plurality of receptacles of the type illustrated in FIG. 8.

FIG. 9 of the drawings illustrates a shipping in storage container 160 suitable for use in storing a plurality of assemblies 158 and a plurality of thinner containers 156. The container 160 has chamber 162 which is divided into storage compartments by projections 164 which extend inwardly from opposite sides thereof. A cover 166 is provided which fits over the open upper end of the container 160. A pair of brush handles 168 are releasably mounted in the cover 160. The combination of container 160 assemblies 158, thinner containers 156, cover 166, and handles 168 provides a complete painting kit. This kit is extremely compact and convenient to use, and provides for the storage of paint brushes over an extended period of time while preventing the deterioration normally associated with the storage of paint brushes.

The bristle assemblies previously discribed may be molded to the required configuration using any convenient known molding process. Preferrably the molding process is one which permits the fast setting resins previously described to be used in the manufacture of the bristle assemblies.

From the foregoing, it would be apparent that the present invention provides a simple and inexpensive paint brush assembly.

Figure 10:
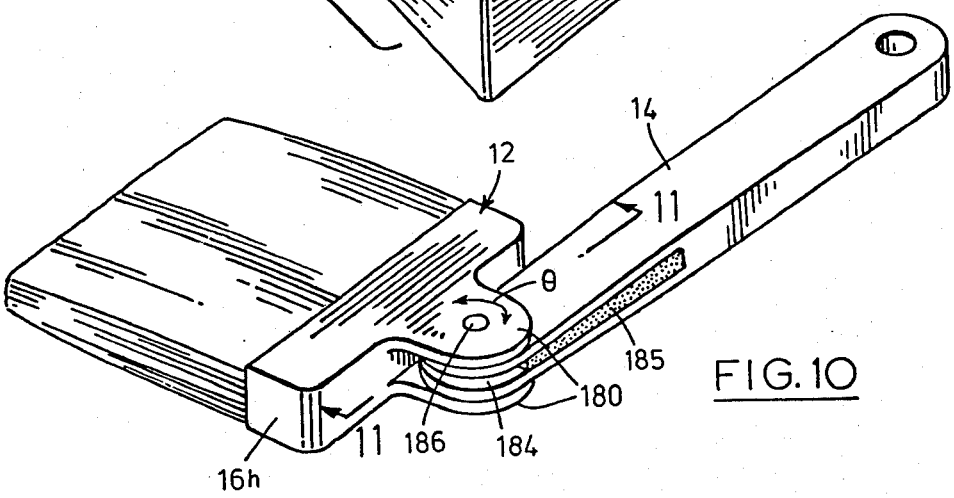
FIG. 10 is a pictorial view of a paint brush constructed in accordance with a further embodiment of the present invention in which the head which forms the bristle assembly is angularly adjustable.
Figure 11:
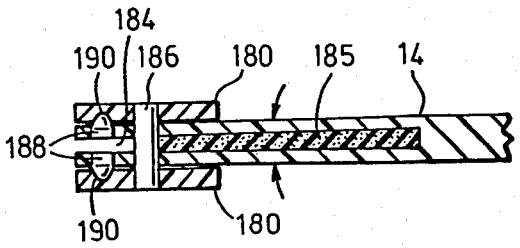
FIG. 11 is a sectional view taken along the line 11—11 of FIG. 10.

FIGS. 10 and 11 illustrate yet another embodiment of the present invention in which the bristle assembly 12 is mounted on the handle 14 so as to be movable between a longitudinally aligned position and an angularly inclined position. In this embodiment the head 16*g* of the bristle assembly 12 is formed with a pair of lugs 180. The distal end of the handle is bifurcated to form a pair of arms 182 between which a gap 184 is formed. A resilient insert 185 is located in the gap 184 and serves to urge the arms 182 apart. A pair of locking pins 188 are mounted in and carried by the arms 182 and a plurality of seats 190 are formed in the arms 182 in an arcuate path about the axis of the pin 182. By pressing the arms 182 towards one another the pins 182 are unseated to permit the bristle assembly 12 to be relocated at any angle at which seats 190 permit. Preferably the seats 190 are arranged to permit the handle to be aligned with the bristle assembly and to be angularly inclined in both directions at at least two additional settings.

Figure 12:
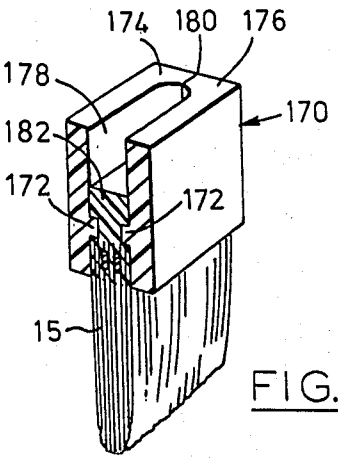
FIG. 12 is a sectional view of a mold suitable for use in molding a paint brush head.

A mold suitable for use in the manufacture of a paint brush head is illustrated in section in FIG. 12. The mold 170 consists of two halves 174 and 176 between which a cavity 187 is formed. A pair of ridges 172 extend along opposite walls of the cavity 178 and are disposed opposite one another. The mold halves 174 and 176 are releasably securable and seperable along split line 180. In use the bristle knot 14 is located with its proximal end extending into the lower end of the cavity 178 and a predetermined quantity of resin is poured into the cavity 178 to extend from the bristles to a level above the ridges 172. The resin will penetrate the proximal end of the bristle knot to embed the bristles therein. After the resin has set to form a head portion 182 the mold 170 is opened along split line 180 and the bristle assembly is removed. In this manner the head portion 182 of the assembly is formed as a ferruleless member with handle mounting channels extending thereacross.

Figure 13:
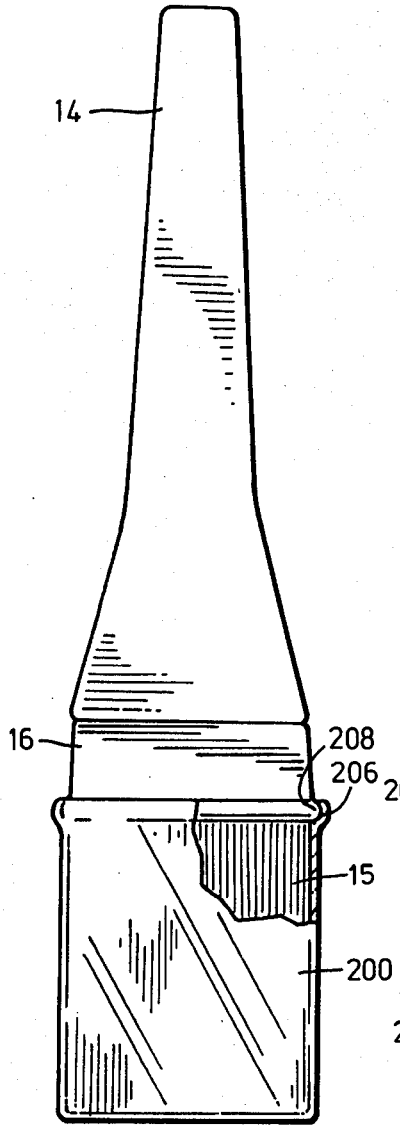
FIG. 13 is a side view of a paint brush storage assembly according to a further embodiment of the present invention in which the storage receptacle is partially sectioned.
Figure 14:
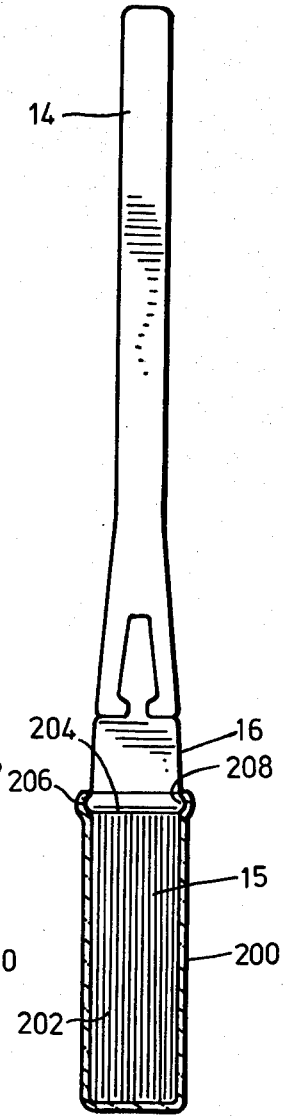
FIG. 14 is a sectional view of the paint brush storage assembly of FIG. 13 taken along the line 14—14.

FIGS. 13 and 14 illustrate a further bristle storage assembly. In the embodiment illustrated in FIGS. 13 and 14 the paint brush handle 14 has a head 16 from which a bristle knot 15 projects. A receptacle 200 has a bristle storage chamber 202 formed therein. The chamber 202 is proportioned to house the bristle knot 15. The chamber 202 has an open end 204 proportioned to admit the bristle knot to the chamber 202. A channel shaped recess 206 extends about the inner periphery of the open end 204. A lip 208 extends about the outer periphery of the distal end of the head 16. The lip 208 and channel 206 are proportioned to provide an airtight seal therebetween when interlocked as shown in FIGS. 13 and 14 of the drawings.

The receptacle 200 is preferably made from a plastic material which is resistent to conventional paint solvents and is sufficiently flexible to permit the open end 204 to be resiliently deformed to admit the lip 208 to the channel recess 206 to achieve mounting of the brush head and the receptacle, and to provide an airtight seal between the lip 208 and the channel 206.

Various modifications of this embodiment of the invention will be apparent to those skilled in the art.

In use the receptacle 200 may be used as a bristle enclosure for a new brush head which will serve to exclude dust and other contaminents from the bristles during shipping and merchandising of the product.

After the head has been used in painting operation, the receptacle may be used to store the bristles in the good condition by placing a small quantity of paint solvent in the receptacle before the airtight seal is established between the head and the receptacle. By providing an air and fluid type seal between the head and the receptacle, the bristles may be maintained in a good condition for a substantially indefinite period.

In the embodiment illustrated in FIGS. 13 and 14, the head 16 is illustrated in a form in which it is detachable from the handle 14. While there is a substantial advantage to this embodiment in that the combination of the detachable head and receptacle forms a compact storage assembly, it will be understood that the receptacle of the present invention may be used in combination with a unitary handle having a lip 208 located at the end from which the bristle knot projects. These and other modifications of the present invention will be apparent to those skilled in the art.

I claim:

1. A storage device for paint brushes comprising;

(a) a receptacle having a chamber formed therein, said chamber being proportioned to receive at least a major portion of a paint brush head in a close fitting relationship, (b) a closure cap adapted to sealingly engage the receptacle to seal said chamber.

2. A storage device for paint brushes as claimed in claim 1 wherein said receptacle is transparent.

3. A storage device for paint brushes as claimed in claim 1 further comprising valve means opening into said chamber through which conditioning fluid may be introduced into said chamber when said cap is sealed to said receptacle.

4. A storage device for paint brushes as claimed in claim 1 further comprising; a paint brush head mounted in said chamber.

5. A paint brush storage assembly comprising (a) a storage container having a storage enclosure, (b) a purality of receptacles each having a chamber formed therein, said chamber being proportioned to receive at least a major portion of a paint brush head in a close fitting relationship, (c) said storage container being formed with a plurality of compartments each adapted to receive and support one of said receptacles in an upright side-by-side relationship, (d) a closure cap adapted to engage said storage container to close said compartments.

6. A paint brush storage assembly as claimed in claim 5 wherein said closure cap is formed with a storage compartment adapted to support a paint brush handle.

7. An airtight bristle enclosure for paint brushes of the type having a bristle knot projecting from one end of the head thereof, comprising a receptacle having a chamber formed therein, said chamber being proportioned to house said bristle knot, said chamber having an open end proportioned to admit said bristle knot, said open end being adapted to sealingly engage said one end of said head thereby to provide an airtight closure of said chamber when said bristle knot is located therein whereby a paint solvent fluid may be stored in said chamber in contact with said bristles.

8. A paint brush storage assembly comprising:

(a) a paint brush head having a bristle knot projecting from one end thereof; and, (b) a receptacle having a bristle storage chamber formed therein, said chamber being proportioned to house said bristle knot, said chamber having an open end proportioned to admit said bristle knot to said chamber, said open end being adapted to sealingly engage said one end of said head thereby to provide an airtight closure of said chamber when said bristle knot is located therein whereby a paint solvent fluid may be stored in said chamber in contact with said bristle.

9. A paint brush storage assembly as claimed in claim 8 wherein said head and said receptacle are adapted to sealingly engage as aforesaid by providing an interlocking, airtight sealing channel and lip formed one on said one end of said head and the other in said open end of said receptacle.

10. A paint brush storage assembly as claimed in claim 9 wherein said lip is formed about the periphery of the distal end of said head and said channel is formed about the inner periphery of said open end of said receptacle.

* * * * *